US008792647B2

(12) United States Patent
Sidhu

(10) Patent No.: US 8,792,647 B2
(45) Date of Patent: Jul. 29, 2014

(54) CIRCUIT DEVICE FOR PROVIDING A THREE-DIMENSIONAL SOUND SYSTEM

(76) Inventor: Dalwinder Singh Sidhu, Old Bridge, NJ (US)

( * ) Notice: Subject to any disclaimer, the term of this patent is extended or adjusted under 35 U.S.C. 154(b) by 411 days.

(21) Appl. No.: 12/971,023

(22) Filed: Dec. 17, 2010

(65) Prior Publication Data

US 2012/0155654 A1 Jun. 21, 2012

(51) Int. Cl.
*H04R 5/00* (2006.01)
*H04R 5/04* (2006.01)

(52) U.S. Cl.
CPC ..... *H04R 5/04* (2013.01)
USPC ..... 381/28; 381/310; 381/61

(58) Field of Classification Search
USPC ..... 381/28, 61, 17, 309–310
See application file for complete search history.

(56) References Cited

U.S. PATENT DOCUMENTS 6,421,448 B1 * 7/2002 Arndt et al. ..... 381/312
8,213,648 B2 * 7/2012 Kimijima ..... 381/310
2008/0130918 A1 * 6/2008 Kimijima ..... 381/107

* cited by examiner

*Primary Examiner* — Disler Paul
(74) *Attorney, Agent, or Firm* — Arthur M. Peslak

(57) ABSTRACT

A circuit device for a three-dimensional sound system is disclosed. The device circuit contains a plurality of resistors, capacitors and transistors. The circuit is an analog circuit creating an actual three-dimensional sound system where the listener can perceive sound coming from different spatial directions. The circuit device accomplishes this by sensing the amplitude and phase difference between the sound signals.

4 Claims, 1 Drawing Sheet

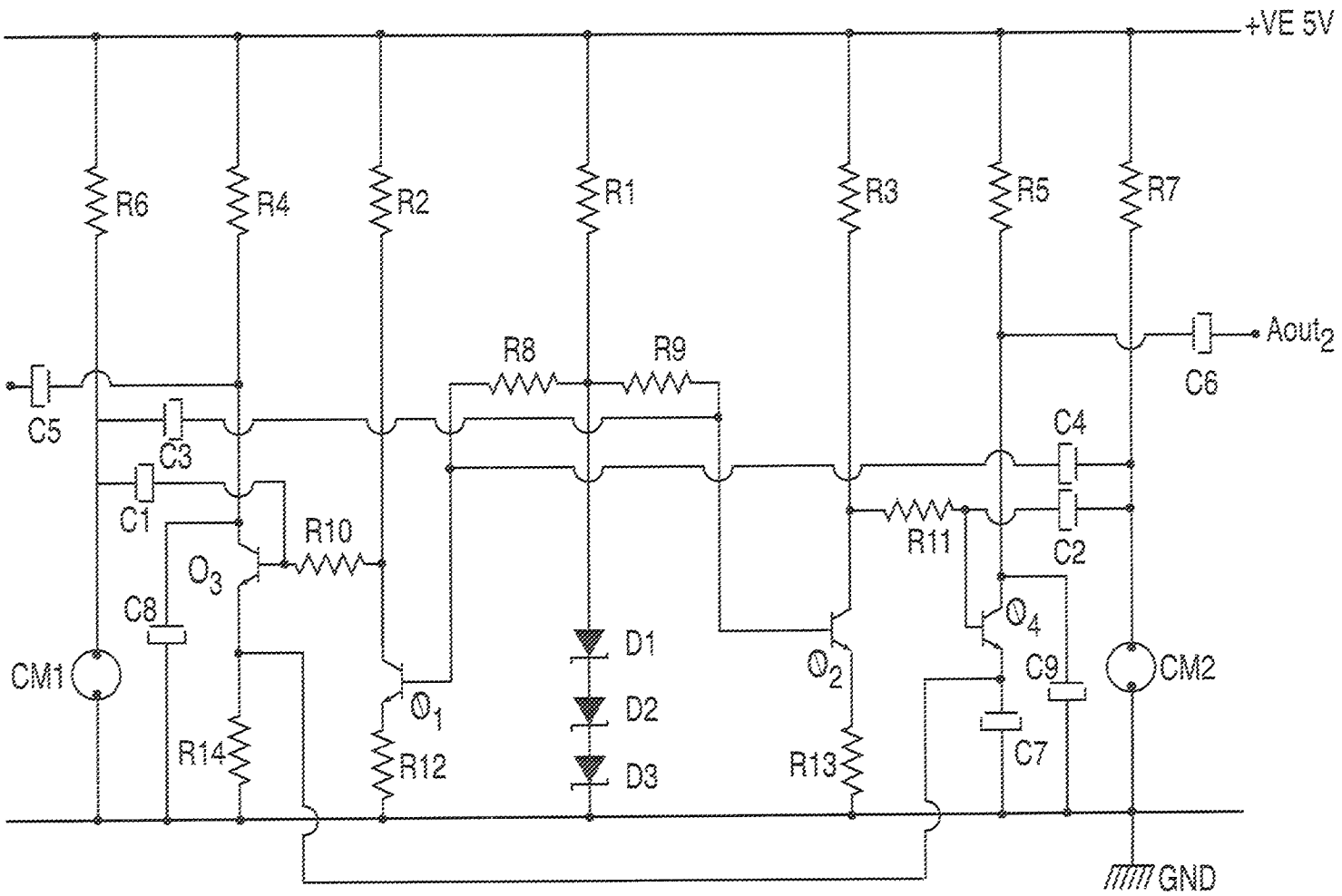
+VE 5V
Aout2
C6
R7
CM2
GND
C4
C2
C9
R5
Q4
C7
R11
R3
Q2
R13
R9
D1
D2
D3
R1
R8
Q1
R12
R2
R10
R4
Q3
R14
C3
C1
C8
R6
C5
CM1

CIRCUIT DEVICE FOR PROVIDING A THREE-DIMENSIONAL SOUND SYSTEM

BACKGROUND OF THE INVENTION

The present invention is directed to the field of sound systems. In particular, the present device is directed to a sound circuit device for providing three-dimensional electronic sound effects.

The widespread progress of multimedia technology has created a demand for three-dimensional sound systems as an improvement upon two-dimensional stereo sound. In a three-dimensional system, a pair of speakers or earphones allows the listener to perceive sounds coming from different spatial directions thus creating a more realistic feeling when listening to music or other sound sources such as video games, movies, etc.

Many of the existing sound systems that claim to be three-dimensional systems, in reality, simulate a three-dimensional effect by manipulating two-dimensional signals. The existing systems do this by using software to take conventional sound systems and simulate a three-dimensional effect by manipulating the electronic signals. The primary problem with the available simulated three-dimensional systems is the sound becomes distorted as the three-dimensional effect is simulated.

SUMMARY OF THE INVENTION

The primary object of the present invention is to provide a simple circuit device that provides an actual three-dimensional sound system. The circuit device of the present invention accomplishes this object without the use of software to manipulate the sound signals and thus creates an actual three-dimensional sound system. By comparing the amplitude and phase of a plurality of sound signals, a real time three-dimensional sound effect is created by manipulating the amplitude of the output signals based upon a comparison of the amplitude and phase of the input signals.

BRIEF DESCRIPTION OF THE DRAWINGS

FIG. 1 is a schematic diagram of the circuit device of the present invention.

DETAILED DESCRIPTION OF THE INVENTION

The present invention will now be described in terms of the presently preferred embodiment as illustrated in the drawings. The present invention is directed to a circuit device that provides a true real time three-dimensional sound effect without the distortion generated by digitally simulating a three-dimensional effect.

The circuit device of the present invention comprises two independent and identical and sound channels. Mono tonus sound signal is suppressed. The system comprises a signal processor which does this job. The signal processor senses the amplitude and the phase of the sound signals in the two sound channels. Based upon the amplitude of the two signals, the processor decides which of the sound signals is dominant. If one signal is dominant, the signal processor will amplify that sound signal more than the other signal. The amount of amplification depends on the phase difference between the two signals. A greater phase difference will result in greater amplification of the dominant signal. The amplification of the sound signal on the other channel will be less and also determined based upon the phase difference. If both sound signal channels are equal, the amplification of the signals will be equal again since there will be no phase difference. If there is only one sound source, the processing will be identical and instantaneous. If there is more than one sound source, the processing will respond differently to each signal.

MONO TONE signal is defined as an audio signal received on two microphones at different distances with the phase difference between the two signals equal to zero. The microphone which is further away from the sound source receives the first wave. The microphone which is closer to the sound source receives the second wave or a harmonic fraction of the original wave. Two such signals will produce a false impression of dimension. The circuit device of the present invention suppresses MONO TONE signals because such signals cause harmonic distortion and false dimension.

Circuit Device Description

The preferred embodiment of the circuit device of the present invention is illustrated schematically in FIG. 1. The components of the circuit device shown in FIG. 1 are defined in Table 1.

The Audio 1 sound signal from Cm1 is fed by C1 to Q3 (part of differential amp ac) and Q2 (phase inverter) by C3. The Audio 2 sound signal from Cm2 is fed by C2 to Q4 (part of differential amp ac) and Q1 (phase inverter) by C4. In this embodiment, Cm1 and Cm2 are condenser microphones but any equivalent device that can receive a sound signal may be substituted. The amplitude of the Audio 1 signal is compared with the amplitude of Audio 2 at the inverter Q2. Whichever signal, Audio 1 or Audio 2, is greater, will be the dominant signal. In this case, the dominant signal will overpower the other signal and minimize the effect on amplification of the other signal.

The following examples illustrate the operation of the circuit device of the present invention:

Example 1

The amplitude of Audio 1 equals the amplitude of Audio 2. The phase difference between Audio 1 and Audio 2 is 0. In this case, both Audio 1 and Audio 2 will be amplified moderately with no addition and or subtraction of the signals.

Example 2

The amplitude of Audio 1 is greater than the amplitude of Audio 2. The phase difference between Audio 1 and Audio 2 is 90 degrees. Audio 1 will be the dominant signal and nullify the effect of inverted Audio 2 which is fed to Q3. In this case, the Audio 1 output signal will be greater than the Audio 2 output. Since Audio 1 is greater than Audio 2, it is fed inverted to Q4. This will reduce the amplification at Q4 and Audio 2 will be 45 degrees behind Audio 1. Consequently, C7 will need to charge before Audio 2 is amplified. As a result, the amplification of Audio 2 is minimized because of the phase lag between Audio 1 and Audio 2. The large difference in output amplitude between Audio 1 and Audio 2 will generate the direction of the sound source to the user. Input amplitude of both signal gives distance.

When the amplitude of Audio 1 is less than the amplitude of Audio 2, the same process will occur but the amplification of the two signals will be reversed. The three-dimensional sound effect is created in this way. The first dimension is the presence of an audio signal. The second dimension is the amplitude represented by the distance traveled by the sound source to the input. The third dimension is the amplitude modulation created by the signal processor with respect to the phase difference between the signals.

SUMMARY

When the phase difference between the two channels is 0 and the amplitude of the signal is same, the amplification of both channels by the signal processor is moderate.

When the phase difference between the two channels is in the range of −270 to +90 degrees, amplification by the signal processor on the dominant channel is moderate and the other channel is suppressed.

When the phase difference is in the range of +90 to 270 degrees and the amplitude of one signal is large and the other signal is small, then amplification by the signal processor on the dominant channel is maximum and on the other channel is minimum.

As those of ordinary skill in the art will recognize, there are many applications in which the circuit design of the present invention may be used. Among the contemplated applications are sound systems, video games, movies, security cameras, self-guidance systems for missiles, and real aircraft mode microphones. Many obvious mode features and applications may be recognized and implemented by those of ordinary skill in the art without departing from the spirit or scope of the present invention as set forth in the appended claims.

TABLE 1

| COMPONENTS | | |
|---|---|---|
| RESISTORS (R) | R1-R6 | 1 KΩ |
| | R7-R8 | 22 KΩ |
| | R9-R11 | 1 MΩ |
| | R12-R13 | 150 Ω |
| | R14 | 3.2 KΩ |
| DIODES (D) | D1-D3 | 1n4148 or any equivalent general purpose silicon diodes (Bias Stabiliz (Bias Stabilizers) |
| CAPACITORS | C1-C6 | 1 μF |
| | C7 | At least 1 μF |
| | C8-C9 | .1 μF |
| TRANSISTORS (Q) | Q1-Q2 | Phase Inverters—Small Signal, General Purpose NPN Silicon |
| | Q3-Q4 | AC Differential AMPS—Small Signal, General Purpose NPN Silicon |
| SOUND SOURCES | Cm1 & Cm2 | Condenser Microphones |

TABLE 1-continued

| COMPONENTS | | |
|---|---|---|
| AUDIO OUTPUT | Aout1 | Audio Output 1 |
| | Aout2 | Audio Output 2 |
| POWER SUPPLY | | 5 V Regulated DC |

What is claimed is:

1. An analog circuit device as shown for processing sound signals to produce an actual real time three-dimensional sound output comprising: a) two devices for receiving a first and a second sound signal where the first and second sound signals each comprise an amplitude and a phase; b) determining circuitry comprising analog components to determine the amplitude and phase of the first and second sound signals, including two inverters and two amplifiers which receive the first and second signals, three diodes which are bias stabilizers, six coupling capacitors and two intermediate frequency suppressors;

c) comparative circuitry comprising an analog phase inverter components to determine the amplitude and phase of the first and second sound signals and determine the dominant sound signal, including a seventh capacitor which holds an electrical charge and is discharged through a resistor;

d) amplifying circuitry comprising analog components to amplify the sound signals for output wherein the amount of amplification of the sound signals are determined based upon a phase difference between the sound signals, including two amplifiers, which are fed with the first signal directly and the second signal as a bias signal alter inversion; and e) an output device for outputting first and second output sound signals to a user after amplification.

2. The circuit device of claim 1 wherein the amplitude of the first and second sound signals are equal and the phase difference is 0.

3. The circuit device of claim 1 wherein the first sound signal is the dominant signal and the phase difference between the first and second sound signal is 90 to 270 degrees and the circuit device causes the second sound signal to lag behind the first sound signal by 45 degrees and thereby produce output signals when the first sound output signal is much larger than the second output sound signal.

4. The circuit device of claim 1 wherein the first or second sound signal is the dominant sound signal and the phase difference between the first and second sound signal is −270 to 90 degrees and the output signal on the dominant channel is amplified and the second sound signal is suppressed.

* * * * *